United States Patent [19]

Musumeci et al.

[11] Patent Number: 4,723,801

[45] Date of Patent: Feb. 9, 1988

[54] CLIP ON BABY BOTTLE HOLDER

[76] Inventors: Salvatore Musumeci; Lorraine Musumeci, both of 145-77 8th Ave., Whitestone, N.Y. 11357

[21] Appl. No.: 6,792

[22] Filed: Jan. 27, 1987

[51] Int. Cl.[4] ..... A47D 15/00; B65D 23/10

[52] U.S. Cl. ..... 294/33; 248/102; D7/70; D9/455

[58] Field of Search ..... 294/27.1, 31.2, 33, 294/99.1; D7/70, 71; D9/455; D24/47, 48; 16/114 R; 215/11 R, 11 C, 100 A; 220/85 H; 248/102–104, 145.6

[56] References Cited

U.S. PATENT DOCUMENTS

| | | | |
|---|---|---|---|
| D. 180,439 | 6/1957 | Coleman | D7/70 |
| D. 236,410 | 8/1975 | Jenkins et al. | 294/33 X |
| 2,029,051 | 1/1936 | Blevins | 294/33 |
| 2,655,403 | 10/1953 | Ernest | 294/33 |
| 2,926,038 | 2/1960 | Hyams | 294/33 |
| 3,773,287 | 11/1973 | Hechinger | 294/31.2 X |
| 3,990,596 | 11/1976 | Hoftman | 294/33 X |
| 4,120,073 | 10/1978 | Studebaker | 294/33 X |

FOREIGN PATENT DOCUMENTS

| | | | |
|---|---|---|---|
| 3021110 | 12/1981 | Fed. Rep. of Germany | 248/104 |

*Primary Examiner*—Johnny D. Cherry
*Attorney, Agent, or Firm*—Michael I. Kroll

[57] ABSTRACT

A clip on baby bottle holder is provided and consists of a handle member and two C-shaped clamp members which engage a baby bottle. The handle can be gripped by a baby and also be used as a teething member. In a modification only one C-shaped clamp member is used to engage a baby bottle.

4 Claims, 4 Drawing Figures

CLIP ON BABY BOTTLE HOLDER

BACKGROUND OF THE INVENTION

1. Field of the Invention

The instant invention relates generally to handle attachments and more specifically it relates to a clip on baby bottle holder.

2. Description of the Prior Art

Numerous handle attachments have been provided in prior art that are adapted to be attached to various types of containers. For example U.S. Pat. Nos. 231,634; 601,988; 622,862; 3,794,370; 4,379,578 and Re. 29,708, all are illustrative of such prior art. While these units may be suitable for the particular purpose to which they address, they would not be as suitable for the purposes of the present invention as heretofore described.

SUMMARY OF THE INVENTION

A primary object of the present invention is to provide a clip on baby bottle holder that will overcome the shortcomings of the prior art devices.

Another object is to provide a clip on baby bottle holder that includes a handle which can be quickly gripped by a baby and also be used as a teething member.

An additional object is to provide a clip on baby bottle holder that includes at least one clamp member which tightly engages the baby bottle once clipped on and cannot be removed by a baby until an adult decides to remove the holder.

A further object is to provide a clip on baby bottle holder that is simple and easy to use.

A still further object is to provide a clip on baby bottle holder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
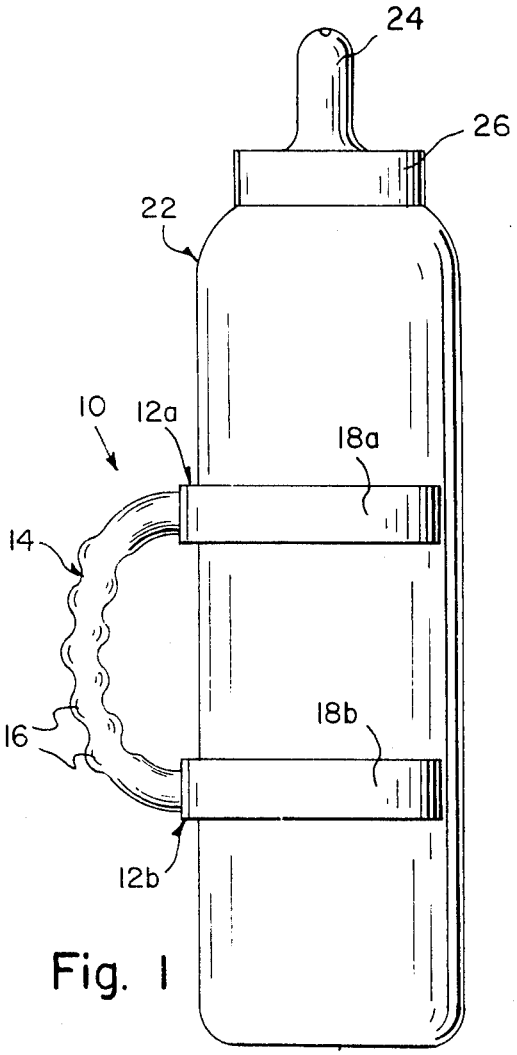
FIG. 1 is a side elevational view of the invention attached to a baby bottle.
Figure 2:
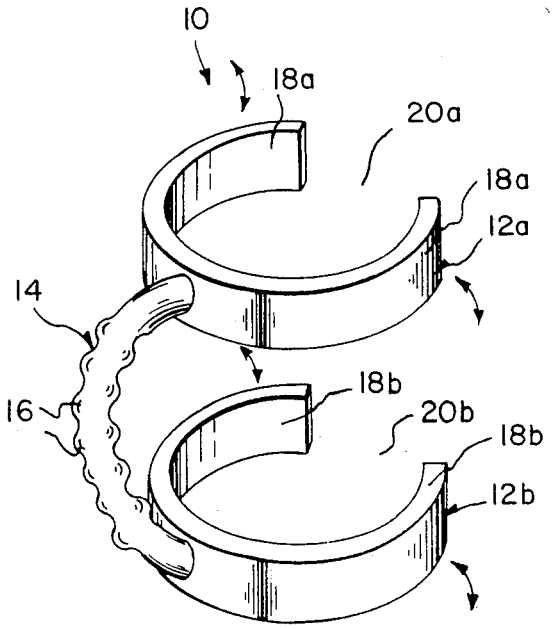
FIG. 2 is a perspective view of just the bottle holder.
Figure 3:
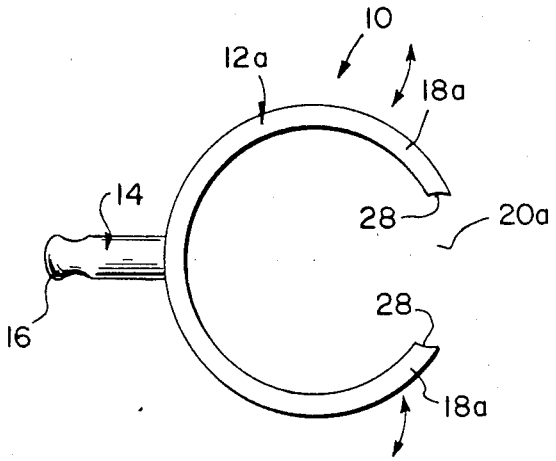
FIG. 3 is a top view thereof.

Turning now descriptively to the drawings, in which similar reference characters denote similar elements throughout the several views, FIGS. 1, 2 and 3 illustrate a clip on baby bottle holder 10 consisting of a generally C-shaped handle member 14 and a pair of generally C-shaped clamp members 12*a* and 12*b*. Each clamp member is integrally formed on each end of the handle member 14 to extend substantially perpendicular to the handle member 14 and adapted to engage a baby bottle 22 for securing the handle member 14 to the bottle 22. A nipple 24 and cap 26 is provided for the baby bottle 22. Each of the clamp members 12*a*, 12*b* include a pair of flexible curved arms 18*a*, 18*b* having a gap 20*a*, 20*b* therebetween so that the curved arms can snap onto the baby bottle 22. Each of the curved arms 18*a*, 18*b* can further have a concave end 28, as best seen in FIG. 3, so as to slide onto the baby bottle 22 for assisting the curved arms 18*a*, 18*b* when snapping onto the baby bottle.

The handle member 14 further includes integral finger grip formations 16 thereon so that a baby can easily grip the handle member 14 and also use the handle member as a teething member. The baby bottle holder 10 is integrally formed out of a substantially homogeneous synthetic plastic material.

Figure 4:
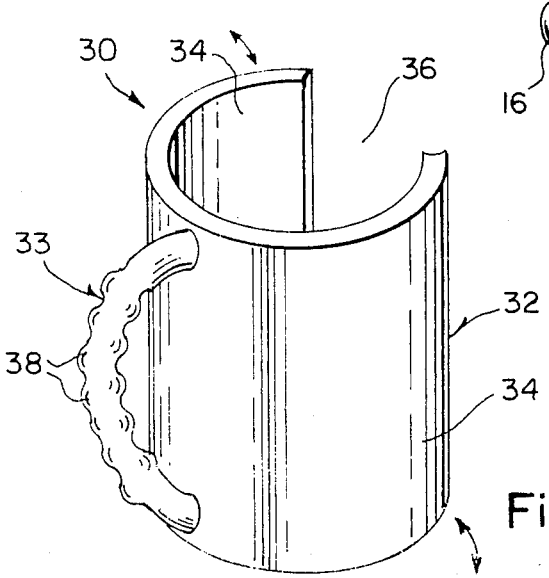
FIG. 4 is a perspective view of a modified bottle holder.

FIG. 4 shows a modified clip on baby bottle holder 30. Instead of using a pair of clamp members 12*a* and 12*b* one generally C-shaped clamp member 32 is provided, with each end of C-shaped handle member 33 integrally and longitudinally formed thereon. The clamp member 32 is adapted to engage the baby bottle 22, shown in FIG. 1, for securing the handle member 14 to the bottle. The clamp member 32 includes a pair of flexible curved arms 34 having a gap 36 therebetween so that the curved arms 34 can snap onto the baby bottle 22.

The handle member 33 further includes integral finger grip formations 38 thereon, like handle 14, so that a baby can easily grip the handle member 33 and also use the handle member as a teething member. The baby bottle holder 30 is also integrally formed out of a substantially homogeneous synthetic plastic material.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A clip on baby bottle holder and teething member, comprising:

(a) a generally C-shaped handle member having a peripheral surface; and (b) a pair of generally C-shaped clamp members, each integrally formed on each end of said handle member to extend substantially perpendicular to said handle member and adapted to engage a baby bottle for securing said handle member to said bottle, each of said clamp members including a pair of flexible curved arms having a gap therebetween so that said curved arms can snap onto said baby bottle, each of said curved arms further having a concave end so as to slide onto said baby bottle for assisting said curved arms when snapping onto said baby bottle, said handle member including protrusions disposed on said peripheral surface in a random fashion so that a baby can easily grip said handle member and also use said handle member as the teething member.

2. A clip on baby bottle holder as recited in claim 1, being integrally formed out of a substantially homogeneous synthetic plastic material.

3. A clip on baby bottle holder and teething member, comprising:

(a) a generally C-shaped handle member having a peripheral surface; and (b) at least one generally C-shaped clamp member with each end of said handle member integrally and longitudinally formed thereon, said at least one clamp member being adapted to engage a baby bottle for securing said handle member to said bottle, said at least one clamp member including a pair of flexible curved arms having a gap therebetween so that said curved arms can snap onto said baby bottle, each of said curved arms further having a concave end so as to slide onto said baby bottle for assisting said curved arms when snapping onto said baby bottle, said handle member including protrusions disposed on said peripheral surface in a random fashion so that a baby can easily grip said handle member and also use said handle member as the teething member.

4. A clip on baby bottle holder as recited in claim 3, being integrally formed out of a substantially homogeneous synthetic plastic material.

* * * * *